US006228571B1

(12) United States Patent
Hatakeyama

(10) Patent No.: US 6,228,571 B1
(45) Date of Patent: May 8, 2001

(54) PHOTOTHERMOGRAPHIC MATERIAL

(75) Inventor: Akira Hatakeyama, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 08/877,907

(22) Filed: Jun. 18, 1997

(30) Foreign Application Priority Data

Jun. 18, 1996 (JP) ..... 8-177494

(51) Int. Cl.[7] ..... G03C 1/498

(52) U.S. Cl. ..... 430/531; 430/523; 430/533; 430/534; 430/536; 430/619

(58) Field of Search ..... 430/619, 531, 430/533, 534, 536, 523

(56) References Cited

U.S. PATENT DOCUMENTS 3,801,321 * 4/1974 Evans et al. .
4,529,689 * 7/1985 Lee ..... 430/534
4,987,061 * 1/1991 Helling et al. ..... 430/531
5,610,006 * 3/1997 Yokokawa et al. ..... 430/604
5,677,121 10/1997 Tsuzuki .
6,060,228 * 5/2000 Suzuki ..... 430/522

OTHER PUBLICATIONS

The Condensed Chemical Dictionary, Tenth Edition, Eessner G. Hawley, 1981.*
Research Disclosure Jul. 1980, pp. 301–310.*

* cited by examiner

*Primary Examiner*—Thorl Chea
(74) *Attorney, Agent, or Firm*—Birch, Stewart, Kolasch & Birch, LLP

(57) ABSTRACT

A photothermographic material has on one surface of a support at least one photosensitive layer containing a photosensitive silver halide, an organic silver salt, and a reducing agent. A non-photosensitive layer or back layer is formed on the back surface of the support by applying a coating solution of a binder containing at least 50% by weight of a polymer latex dispersed in a solvent containing at least 30% by weight of water and drying the coating. The polymer latex is of a polymer having an equilibrium moisture content of less than 2% by weight at 25° C. and RH 60%. The back layer can be coated at a low cost without a need for a harmful organic solvent. Upon storage in a humid atmosphere, sheets of the material are minimized in fog and free of sticking.

13 Claims, No Drawings

PHOTOTHERMOGRAPHIC MATERIAL

BACKGROUND OF THE INVENTION

This invention relates to a photothermographic material capable of forming an image through heat development and more particularly, to a photothermographic material having a non-photosensitive layer on the back surface, that is, a back layer which can be coated at a low cost without a need for a harmful organic solvent. The photothermographic material is often referred to as a photosensitive material.

There are known many photosensitive materials comprising a photosensitive layer on a support which are exposed imagewise to form images. Among them, a process of forming an image through heat development is known as an environment friendly system capable of simplifying image forming means.

The process of forming an image through heat development is disclosed, for example, in U.S. Pat. No. 3,152,904 and 3,457,075, and D. Morgan and B. Shely, "Thermally Processed Silver Systems" in "Imaging Processes and Materials," Neblette, 8th Ed., Sturge, V. Walworth and A. Shepp Ed., page 2, 1969. These photosensitive materials generally contain a reducible non-photosensitive silver source (e.g., organic silver salt), a catalytic amount of a photocatalyst (e.g., silver halide), and a reducing agent for silver, typically dispersed in an (organic) binder matrix. Photosensitive materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming a black and white image.

In conjunction with photothermographic materials, it is well known to form a back layer by applying a coating solution of a binder in an aqueous solvent and drying the coating. Such a back layer is referred to as an aqueous back layer, hereinafter. For example, JP-A 254443/1990 discloses the use of gelatin as the binder and JP-A 129220/1976 discloses the use of polyvinyl alcohol as the binder.

As compared with back layers formed by applying a coating solution of a binder in an organic solvent and drying the coating, the aqueous back layers have environmental and economical advantages that they eliminate the detrimental influence of organic solvents on the environment and human body as well as the recovery of organic solvents.

Photosensitive materials having such aqueous back layers, however, suffer from drawbacks that when sheets of photosensitive material are stored in a humid atmosphere, fog increases and sheets stick to each other. It is then desirable to provide a photosensitive material with a back layer which is free of a fog increase, a sticking phenomenon, and detrimental influence on the environment and human body and is economically advantageous.

SUMMARY OF THE INVENTION

An object of the present invention is to provide a novel and improved black and white photothermographic material capable of forming a black and white image through heat development. The material has a non-photosensitive layer on the back surface, that is, a back layer which is free of a fog increase and a sticking phenomenon even when sheets of the material are stored in a humid atmosphere, and wherein the back layer can be formed without a need for organic solvents which are harmful to the environment and human body and relatively expensive.

According to the invention, a photothermographic material forming an image through heat development is provided comprising a support having a pair of opposed surfaces and at least one photosensitive layer on one surface thereof. The photosensitive layer contains (i) a photosensitive silver halide, (ii) a non-photosensitive silver salt, and (iii) a reducing agent for the silver salt. The photothermographic material further includes a non-photosensitive or back layer on the other or back surface of the support. The non-photosensitive layer is formed by dispersing a binder containing at least 50% by weight of a polymer latex in a solvent containing at least 30% by weight of water to form a coating solution, applying the coating solution, and drying the coating. The polymer latex is typically of a polymer having an equilibrium moisture content of up to 2% by weight at 25° C. and RH 60%.

In one preferred embodiment, the non-photosensitive silver salt is an organic silver salt, more preferably a silver salt of an aliphatic carboxylic acid having at least 10 carbon atoms.

DESCRIPTION OF THE PREFERRED EMBODIMENTS

Back Layer

According to the invention, the photothermographic material has a photosensitive layer on one surface and a non-photosensitive layer on the other surface of a support. Since the other surface is a back surface, the non-photosensitive layer is also designated a back layer. The back layer is formed by dispersing a binder containing at least 50% by weight of a polymer latex in a solvent (or dispersing medium) containing at least 30% by weight of water to form a coating solution, applying the coating solution, and drying the coating.

With respect to the polymer latex used herein, reference should be made to Okuda & Inagaki Ed., "Synthetic Resin Emulsion," Kobunshi Kanko-kai, 1978; Sugimura, Kataoka, Suzuki & Kasahara Ed., "Applications of Synthetic Latex," Kobunshi Kanko-kai, 1993; and Muroi, "The Chemistry of Synthetic Latex," Kobunshi Kanko-kai, 1970. The dispersed particles preferably have a mean particle size of about 1 to 50,000 nm, more preferably about 5 to 1,000 nm. The particle size distribution of the dispersed particles is not critical. Either a wide particle size distribution or a monodisperse particle size distribution is acceptable.

The polymer latex used herein encompasses polymer latices of both the conventional uniform structure and the core/shell structure. Polymer latices of the core/shell structure wherein the core and the shell have different glass transition temperatures are sometimes preferred.

Preferably the polymer latices used herein have a minimum film-forming temperature (MFT) of about −30° C. to 90° C., more preferably about 0° C. to 70° C. Film-forming assistants may be added in order to control the minimum film-forming temperature. The film-forming assistants also known as plasticizers are organic compounds (typically organic solvents) for lowering the minimum film-forming temperature of polymer latices, examples of which are described in the above-referred Muroi, "The Chemistry of Synthetic Latex," Kobunshi Kanko-kai, 1970.

Included in the polymers used in the polymer latices are acrylic resins, vinyl acetated resins, polyester resins, polyurethane resins, rubbery resins, vinyl chloride resins, vinylidene chloride resins, polyolefin resins, and copolymers thereof.

The polymer of the polymer latex which is used in the non-photosensitive or back layer should preferably have an equilibrium moisture content of less than 2% by weight, preferably 0.1 to 2.0% by weight, more preferably 0.2 to 1.0% by weight at 250° C. and RH 60%.

The equilibrium moisture content of a polymer which is used as the binder is the moisture content (% by weight) that the polymer possesses when equilibrium is reached while the polymer is kept at a temperature of 25° C. and a relative humidity of 60%. With respect to the definition and measurement of the equilibrium moisture content, reference should be made to Japanese Polymer Society Ed., "Polymer Engineering Lecture No. 14—Polymeric Material Test Methods," Chijin Shokan, for example. More specifically, the equilibrium moisture content of a polymer is determined as follows. A polymer film of 5 $\mu$m thick is conditioned in an atmosphere of 25° C. and RH 60% for 48 hours whereupon the weight ($W_1$ grams) of the moist film is measured. The moist film is then conditioned in an absolute dry condition (for example, in a desiccator with a solid phosphorus pentoxide fill) at 25° C. for 48 hours whereupon the weight ($W_2$ grams) of the dry film is measured again. The equilibrium moisture content (Weq) is calculated according to the following expression.

$$Weq=(W_1-W_2)/W_2\times 100\%$$

Use of more 50% by weight of the entire binder of such a polymer latex in a back layer of sheets of photosensitive material is effective for restraining fog occurrence, sheet sticking and hence, surface changes by sticking during storage in a humid atmosphere. If the polymer latex is less than 50% of the entire binder, sheets of photosensitive material would increase fog and stick to each other.

The polymer of the polymer latex may be either a homopolymer having a single monomer polymerized or a copolymer having two or more monomers polymerized together. The polymer may be linear, branched or crosslinked while copolymers include statistical, random, alternating, periodic, and block copolymers. The polymer preferably has a weight average molecule weight Mw of about 3,000 to about 500,000, more preferably about 10,000 to about 200,000 and a number average molecule weight Mn of about 5,000 to about 1,000,000, more preferably about 10,000 to about 100,000. Polymers with a too low molecular weight have insufficient dynamic strength whereas polymers with a too high molecular weight are less film formable.

Examples of the polymer latex which is used as a binder in the non-photosensitive layer or back layer on the back surface of a substrate in the photothermographic material of the invention include latices of methyl methacrylate/ethyl acrylate/methacrylic acid copolymers, latices of methyl methacrylate/2-ethylhexyl acrylate/styrene/acrylic acid copolymers, latices of styrene/butadiene/acrylic acid copolymers, latices of styrene/butadiene/divinyl benzene/methacrylic acid copolymers, latices of methyl methacrylate/vinyl chloride/acrylic acid copolymers, and latices of vinylidene chloride/ethyl acrylate/acrylonitrile/methacrylic acid copolymers.

Illustrative, non-limiting examples of the polymer latex are given below.

P-1 latex of 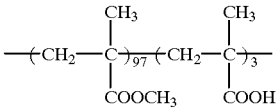

P-2 latex of 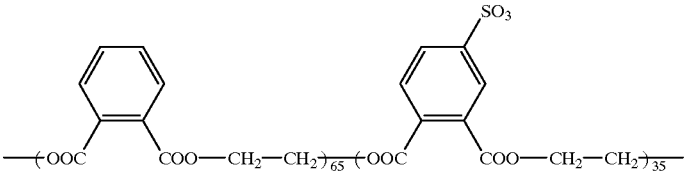

P-3 latex of 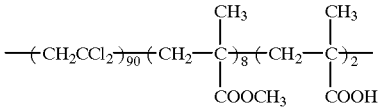

P-4 latex of 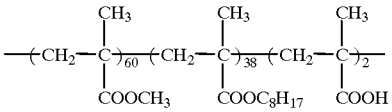

P-5 latex of 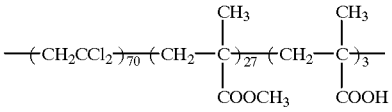

-continued

P-6

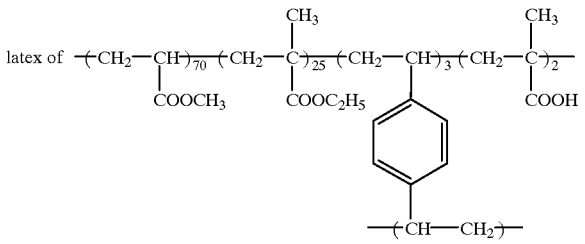

P-7

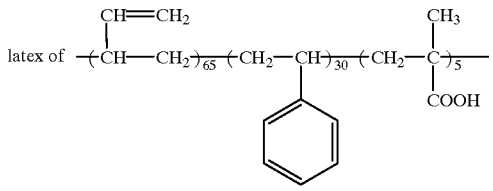

(Suffixal numerical values are % by weight.)

P-8: latex of styrene/butadiene/acrylic acid=70/27/3 (wt %)

P-9: latex of styrene/butyl acrylate/methacrylic acid=65/34/1 (wt %)

P-10: latex of methyl methacrylate/2-ethylhexyl acrylate/acrylic acid=70/27/3 (wt %)

Other useful examples of the polymer latex include acrylic resin latices such as Sebian A-4635, 46583, 45510 and 4601 (Daicell Chemical K.K.), VONCOAT 4280, R3360 and 3297K (Dai-Nihon Ink Chemical K.K.), and Nipol Lx811, 814, 821, 820 and 857 (Nippon Zeon K.K.); polyester resin latices such as FINETEX ES650, 611, 675 and 850 (Dai-Nihon Ink Chemical K.K.) and WD-size, WNT and WMS (Eastman Chemical Products, Inc.); polyurethane resin latices such as HYDRAN AP10, 20, 30, 40 and APX101H (Dai-Nihon Ink Chemical K.K.); rubbery latices such as LACSTAR 7310K, 3307B, 4700H and 7132C (Dai-Nihon Ink Chemical K.K.), Nipol Lx416, 410, 438C, 2507 and 1577 (Nippon Zeon K.K.), and L-1638 and L-2301 (SBR by Asahi Chemicals K.K.); vinyl chloride resin latices such as G351 and G576 (Nippon Zeon K.K.); vinylidene chloride resin latices such as L502 and L513 (Asahi Chemicals K.K.); and olefin resin latices such as Chemipearl S120 and SA100 (Mitsui Petro-Chemical K.K.). Among these polymer latices, latices of styrene-butadiene copolymers are especially preferred.

In the back layer, the polymer latex is used in an amount of a least 50% by weight of the entire binder Insofar as this requirement is met, another polymer may be used in admixture with the polymer latex in the back layer. The other polymers which can be blended are hydrophilic polymers such as gelatin, polyvinyl alcohol, methyl cellulose, hydroxypropyl cellulose, carboxymethyl cellulose and hydroxypropylmethyl cellulose. Such hydrophilic polymers are added in amounts of less than 50% by weight, preferably less than 30% by weight of the entire binder. In contrast, aqueous back layers containing more than 50% by weight of the entire binder of polymers with a greater moisture content such as gelatin and polyvinyl alcohol (PVA) are inadequate because of a substantial fog increase during storage in a humid atmosphere.

In the back layer of the invention, the polymer latices may be used alone or in admixture of two or more.

In the back layer of the invention, the polymer latex is used in amounts of more than 50% by weight of the entire binder. Preferably the polymer latex constitutes more than 55%, especially more than 75% by weight of the entire binder. Most preferably the polymer latex is a sole binder in the back layer. There is a likelihood of fog occurrence and sheet sticking during humid storage if the polymer latex does not occupy more than 50% by weight of the entire binder. It is understood that when a mixture of two or more polymer latices is used, the total weight of the polymer latices combined should be more than 50% by weight of the entire binder.

If desired, various components are added to the back layer of the invention. Useful components include isocyanate and epoxy crosslinking agents, anionic and cationic surfactants, matte agents such as silica and polymethyl methacrylate, paraffin and silicon lubricants, dyestuffs such as antihalation dyestuffs, fillers such as colloidal silica, and conductive fine particles such as $SnO_2$ fine particles as disclosed in JP-A 20033/1986.

More than one back layer may be included in the photosensitive material of the invention. In such an embodiment, at least one layer should be a back layer as specified herein (that is, inventive back layer). Differently stated, the photosensitive material of the invention may include the inventive back layer and an additional back layer other than the inventive back layer, which are coated in combination. Since the benefits of the invention are offset as the additional back layer increases its thickness, the additional back layer should desirably be thinner. More specifically, the thickness of the additional back layer (the total thickness when two or more additional back layers are formed) is desirably less than one-half of the thickness of the inventive back layer (the total thickness when two or more inventive back layers are formed).

In the embodiment wherein an inventive back layer(s) and an additional back layer(s) are formed in combination, the inventive back layer may be disposed close to or remote from the support. Usually, the inventive back layer is preferably disposed as a surface layer for the purpose of preventing photosensitive material sheets from sticking although such a choice also depends on the type of binder and coating technique for the additional back layer. The inventive back layer may be disposed either close to the support or as a surface layer for the purpose of preventing fog.

Where more than one back layer is provided, it is, of course, preferred that all layers be inventive back layers.

Preferably, the inventive back layer has a thickness of about 0.05 to about 20 $\mu$m, more preferably about 0.5 to about 5 μm. When two or more layers are included, the total of their thicknesses meets this thickness range. Further preferably, the inventive polymer is coated in a coverage of about 0.3 to about 7.0 grams per square meter of the photosensitive material.

No particular limit is imposed on the technique of coating the inventive back layer insofar as it is coated from a coating solution obtained by dispersing the polymer latex in a solvent (or dispersing medium) containing more than 30% by weight of water. A choice may be made among known coating techniques including bar coating, air knife coating, dip coating, curtain coating and hopper coating.

The solvent containing more than 30% by weight of water (sometimes referred to as aqueous solvent) is used in the coating solution for forming the inventive back layer. The solvent component other than water is a water-miscible organic solvent such as methyl alcohol, ethyl alcohol, isopropyl alcohol, methyl cellosolve, ethyl cellosolve, dimethylformamide, ethyl acetate and mixtures thereof. Illustrative examples of the solvent include water, water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5, all ratios in % by weight. Insofar as the requirement of more than 30% water is met, the composition of the solvent is not critical. A coating solution using the aqueous solvent is advantageous in reducing the load to the environment and the cost.

Preferably the coating solution for forming the inventive back layer contains the binder (representative of entire binders) and the aqueous solvent in a weight ratio of from about 2:98 to about 15:85.

According to the invention, the back layer is formed by dispersing the binder in the aqueous solvent to form a coating solution, optionally adding thereto other ingredients which are necessary for a particular design of photosensitive material, applying the coating solution to a support, and drying the coating. Drying may be done at a temperature of about 30 to about 180° C. for about ½ to about 10 minutes.

In the photosensitive material of the invention, the back layer may be an antihalation layer which is present as having developed color at a desired wavelength and to a desired absorbance, but is thermally or photo bleachable. Examples are a thermal-dye-bleach construction wherein polymethine dyes of a specific structure are thermally bleached as disclosed in U.S. Pat. Nos. 5,135,842 and 5,258,274, a thermal-dye-bleach construction wherein polymethine dyes are thermally bleached with carboanion-generating agents as disclosed in U.S. Pat. Nos. 5,314,795, 5,324,627 and 5,384,237, and a thermally decolorizable antihalation layer comprising a cation dye combined with a base generating agent as disclosed in JP-A 36145/1995.

Also useful is a construction comprising a dye which is descolorizable by the action of base and basic substance or a precursor thereof separate therefrom wherein the dye is reacted with the basic substance for decolorization by such means as heating. The dye and the basic substance may be separated from each other by adding them in a solid state or by containing the dye and/or the basic substance in thermally responsive microcapsules. In this regard, reference is made to the preparation of heat-sensitive recording materials as described in Moriga, "Introduction to the Chemistry of Special Paper," 1975 and the preparation of heat-sensitive recording materials as described in JP-A 150575/1989. Base generating agents capable of releasing basic substances upon heating and agents capable of generating nucleophilic compounds may be used instead of the basic substance. Exemplary base generating agents are sulfonyl acetate derivatives as disclosed in JP-A 168441/1984 and propiolic acid derivatives as disclosed in JP-A 180537/1984.

Useful thermally bleachable dyes are combinations of a basic colorless dye precursor and an acidic substance as commonly used in heat sensitive recording materials. The amount of the basic colorless dye precursor and acidic substance added is arbitrary although they are preferably used such that the optical density at the desired wavelength is more than about 0.1, more preferably about 0.2 to 2. More specifically, the amount of the basic colorless dye precursor and acidic substance added is about 0.001 to 1 g/m$^2$ of photosensitive material or more although the amount varies with a molecular extinction coefficient. Usually the amount of base generating agent added is at least equimolar to the amount of acidic substance added. For example, the base generating agent is added in an excess amount of three times the moles of the acidic substance.

Alternatively, the back layer may be an antihalation layer containing at least one basic colorless dye precursor, an acidic substance, and a base generating agent. Where the back layer also serves as an antihalation layer, the use of the binder within the scope of the invention in the back layer is effective for preventing degradation of the dye during storage. The use of the binder is also effective for improving the antihalation effect prior to development and for promoting dye bleaching subsequent to development.

Photosensitive Layer

In addition to such a back layer on one surface of a support, the photosensitive material according to the invention further has a photosensitive layer on the opposite surface of the support which contains (i) a photosensitive silver halide, (ii) a non-photosensitive silver salt, and (iii) a reducing agent for the silver salt so that the photothermographic material may form an image through heat development.

A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of adding a halogen-containing compound to a pre-formed organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is less than 0.20 μm, preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and photo-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the plane indices (Miller indices) of an outer surface of silver halide grains. Preferably silver halide grains have a high proportion of {100} plane featuring high spectral sensitization efficiency upon adsorption of a spectral sensitizing dye. The proportion of {100} plane is preferably at least 50%, more preferably at least 65%, most preferably at least 80%. Note that the proportion of Miller index {100} plane can be determined by the method described in T. Tani, J. Imaging Sci., 29, 165 (1985), utilizing the adsorption dependency of {111} plane and {100} plane upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. An appropriate content of the metal complex is $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. Preferred among cobalt and iron complexes are hexacyano metal complexes. Illustrative, non-limiting examples of cobalt and iron complexes include hexacyano metal complexes such as $[Fe(CN)_6]^{4-}$, $[Fe(CN)^6]^{3-}$, and $[Co(CN)_6]^{3-}$. The distribution of the metal complex in silver halide grains is not critical. That is, the metal complex may be contained in silver halide grains uniformly or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethane-sulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding a preformed photosensitive silver halide at any timing during preparation of an organic silver salt. Any desired mixing method may be used insofar as the benefits of the invention are fully achievable.

The non-photosensitive silver salt used herein is a silver salt which is relatively stable to light, but forms a silver image when heated at 80° C. or higher in the presence of an exposed photocatalyst (as typified by a latent image of photosensitive silver halide) and a reducing agent. The non-photosensitive silver salt is preferably an organic silver salt. The organic silver salt may be of any desired organic compound containing a source capable of reducing silver ion. Preferred are silver salts of organic acids, typically long chain aliphatic carboxylic acids having at least 10 carbon atoms, more preferably 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercapto-triazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,768. Compounds containing an imino group may also be used. Preferred examples of these compounds include silver salts of benzotriazole and derivatives thereof, for example, silver salts of benzotriazoles such as silver methyl-benzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide materials also applies to the photothermographic material of the present invention. That is, as organic silver salt grains constituting image forming regions of photothermographic material increase in size, the covering power becomes smaller and the image density becomes lower. It is thus necessary to reduce the grain size. In the practice of the invention, grains should preferably have a minor axis of 0.01 $\mu$m to 0.20 $\mu$m, more preferably 0.01 $\mu$m to 0.15 $\mu$m and a major axis of 0.10 $\mu$m to 5.0 $\mu$m, more preferably 0.10 $\mu$m to 4.0 $\mu$m. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the auto-correlation function of the fluctuation of scattering light relative to a time change, and obtaining the grain size (volume weighed mean diameter) therefrom.

In the practice of the invention, the non-photo-sensitive silver salt is preferably added in an amount of about 0.1 to 20 g/m$^2$, more preferably about 1 to 15 g/m$^2$ as expressed by a coverage of the non-photosensitive silver salt per square meter of photosensitive material. In the photosensitive material of the invention, the total coverage of silver is preferably about 0.05 to about 15 grams per square meter of the photosensitive material.

The reducing agent for the non-photosensitive silver salt may be any of substances, preferably organic substances, that reduce silver ion into metallic silver. Hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly higher amount of about 2 to 15% by weight of that layer.

For photothermographic materials using non-photosensitive silver salts, a wide range of reducing agents are disclosed. Exemplary reducing agents include amidoximes such as phenylamidoxime, 2-thienylamidoxime, and p-phenoxy-phenylamidoxime; azines such as 4-hydroxy-3,5-dimethoxy-benzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones.

It is sometimes advantageous to use an additive known as a "toner" for improving images in addition to the above-mentioned components. The toners are compounds well known in the photographic art as shown in U.S. Pat. Nos. 3,080,254, 3,847,612 and 4,123,282.

Examples of the toner include phthalimide and N-hydroxyphthalimide; cyclic imides such as succinimide, pyrazoline-5-ones, quinazoline, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethyl-pyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methyl-ethylidene}-2-thio-2,4-oxazolidinedione; phthalazinone, phthalazinone derivatives or metal salts, or derivatives such as 4-(1-naphthyl)phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(1-naphthyl) phthlazine, 6-chlorophthalazine, 5,7-dimethoxyphthalazine and 2,3-dihydro-phthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene. The toner is preferably added in an amount of 0.05 to 3 grams, especially 0.5 to 1.5 grams per gram of silver.

A sensitizing dye is also useful in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein.

It is advantageous to select a sensitizing dye having appropriate spectral sensitivity to the spectral properties of a particular light source of various laser imagers, scanners, image setters and printing plate-forming cameras. Exemplary dyes for spectral sensitization to red light include compounds I-1 to I-38 described in JP-A 18726/1979, compounds I-1 to I-35 described in JP-A 75322/1994, and compounds I-1 to I-34 described in JP-A 287338/1995 for He—Ne laser light sources and dyes 1 to 20 described in JP-B 39818/1980, compounds I-1 to I-37 described in JP-A 284343/1987, and compounds I-1 to I-34 described in JP-A 287338/1995 for LED light sources.

Silver halide grains are spectrally sensitized in any wavelength region in the range of 750 nm to 1400 nm. More specifically, photosensitive silver halide can be spectrally advantageously sensitized with various known dyes including cyanine, merocyanine, styryl, hemicyanine, oxonol, hemioxonol and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, UKP 1,466,201, 1,469,117, and 1,422,057, JP-B 10391/1991 and 52387/1994, JP-A 341432/1993, 194781/1994, and 301141/1994. Especially preferred dye structures are cyanine dyes having a thioether bond, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, and Publication of International Patent Application No. 500926/1995.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dyes may be used in admixture of two or more in the practice of the invention. The sensitizing dye is added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoro-propanol, 2,2,2-trifluoroethanol, 3-methoxy-1-propanol, 3-methoxy-1-butanol, 1-methoxy-2-propanol, N,N-dimethyl-formamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to effect dissolution.

The time when the sensitizing dye is added to the silver halide emulsion according to the invention is at any step of an emulsion preparing process which has been acknowledged effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

In the photothermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—SM and Ar—S—S—Ar wherein M is a hydrogen atom or alkali metal atom, and Ar is an aromatic ring or fused aromatic ring group having at least one nitrogen, sulfur, oxygen, selenium or tellurium atom. Preferred hetero-aromatic rings are benzimidazole, naphthimidazole, benzothiazole, naphtho-thiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydro-chloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in UKP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Hydrazine derivatives may be used in the present invention. Typical hydrazine derivatives used herein are the compounds of the general formula (I) described in Japanese Patent Application No. 47961/1994, specifically compounds I-1 to I-53 described therein.

Other hydrazine derivatives are also preferred. Exemplary hydrazine derivatives include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group forming an intramolecular hydrogen bond with the hydrogen atom of hydrazine described in Japanese Patent Application No. 191007/1995, specifically the compounds of the general formulae (A), (B), (C), (D), (E), and (F), more specifically compounds N-1 to N-30 described therein; and the compounds of the general formula (1) in Japanese Patent Application No. 191007/1995, more specifically compounds D-1 to D-55 described therein.

Hydrazine nucleating agents are used by dissolving in suitable water-miscible organic solvents such as alcohols (e.g., methanol, ethanol, propanol, and fluorinated alcohols), ketones (e.g., acetone and methyl ethyl ketone), dimethylformamide, dimethylsulfoxide, and methyl cellosolve.

A well-known emulsifying dispersion method is used for dissolving the hydrazine derivative with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent may be added to a silver halide emulsion layer on a support or any hydrophilic colloid layer on the same side, preferably to the silver halide emulsion layer or a hydrophilic colloid layer disposed adjacent thereto.

An appropriate amount of hydrazine nucleating agent is 1 $\mu$mol to 10 mmol, more preferably 10 $\mu$mol to 5 mmol, most preferably 20 $\mu$mol to 5 mmol per mol of silver halide.

The photosensitive layer is based on a binder. Exemplary binders are gelatin, polyvinyl acetal, polyvinyl chloride, polyvinyl acetate, cellulose acetate, polyolefins, polyesters, polystyrene, polyacrylonitrile, polycarbonate, polyvinyl butyral, butylethyl cellulose, and acrylic polymers. Among these, polyvinyl butyral is preferred. The binder in the photosensitive layer may be a homopolymer having a single monomer polymerized or a copolymer having two or more monomers polymerized together. These polymers may be used alone or in admixture of two or more as desired. The binder is preferably used in the photosensitive layer in such amounts that the weight ratio of the binder to the organic silver salt may range from 15:1 to 1:2, more preferably from 8:1 to 1:1 although the exact weight ratio varies with a particular type of photosensitive material.

The thickness of the photosensitive layer is preferably about 1 to 50 $\mu$m, more preferably about 3 to 30 $\mu$m though not limited thereto. The coverage of the binder in the photosensitive layer is preferably about 0.5 to 30 g/m$^2$, more preferably about 2 to 25 g/m$^2$. In the photosensitive material of the invention, more than one photosensitive layer may be provided. In this case, the total thickness of photosensitive layers and the total coverage of binder should preferably fall in the above-mentioned ranges. For each layer, the thickness is preferably about 1 to 20 $\mu$m, more preferably about 2 to 15 $\mu$m and the binder coverage is preferably about 1 to 15 g/m$^2$, more preferably about 2 to 10 g/m$^2$.

In the photosensitive material of the invention, a non-photosensitive layer, that is, surface protective layer may be provided as the outermost layer on the photosensitive layer side for the purpose of preventing adherence of the photosensitive layer. The surface protective layer is based on a binder. Exemplary binders are naturally occurring polymers and synthetic resins, for example, gelatin, casein, agar, gum arabic, hydroxyethyl cellulose, polyvinyl acetal, polyvinyl chloride, polyvinyl acetate, cellulose acetate, cellulose acetate butyrate, polyolefins, polyesters, polystyrene, polymethacrylic acid, polyvinylidene chloride, polyacrylonitrile, and polycarbonate. Of course, copolymers and terpolymers are included. These polymers may be used alone or in admixture of two or more as desired. The polymer is used in such a range that it may effectively function as a binder to carry various components.

Among these polymers, hydrophilic polymers are preferred. Gelatin is especially preferred. The gelatin may be any type such as lime-treated gelatin and acid-treated gelatin. Gelatin derivatives are also useful. As the binder of the surface protective layer, a latex of a polymer such as ethyl acrylate may be added to the hydrophilic polymer.

The surface protective layer preferably has a thickness of 0.1 to 10 $\mu$m, more preferably 0.5 to 5 $\mu$m. It is preferably formed by applying a coating solution of a binder in an aqueous solvent as previously mentioned and drying the coating.

To the surface protective layer, various components are added if desired, for example, organic silver salts, reducing agents therefor, toners, antifoggants, matte agents, crosslinking agents, dyestuffs, lubricants and surfactants.

The matte agents used in the surface protective layer are preferably microparticulates of polystyrene, polymethyl methacrylate, and silica. Spherical particulates are preferred although the shape of particulates is not critical. Preferably such particulate matte agents have a particle size of about 0.2 to 20 $\mu$m, more preferably about 0.5 to 10 $\mu$m. The amount of the matte agent added is preferably about 10 to 200 mg/m$^2$, more preferably about 20 to 100 mg/m$^2$ although the amount varies with the layer arrangement of the photothermographic material, the thickness of the layer, and the intended application.

The crosslinking agent used for the crosslinking of the surface protective layer may be selected from known ones such as epoxy compounds, isocyanate compounds, melamine compounds, and phenol compounds. Included in the isocyanate compounds are blocked isocyanates. Active halogen compounds and vinyl sulfone compounds are preferred crosslinking agents where the binder of the surface protective layer is gelatin. Boric acid is a preferred crosslinking agent where the binder is polyvinyl alcohol. Preferred crosslinking agents are described in Yamashita, "Crosslinking Agent Handbook," Taiseisha, 1981, for example.

Preferred lubricants are paraffin and silicone compounds.

In the photothermographic material of the invention, another non-photosensitive layer or intermediate layer may be disposed between the photosensitive layer and the surface protective layer. The intermediate layer is based on a binder which is not critical and selected from those binders mentioned in conjunction with the photosensitive layer and the surface protective layer. To the intermediate layer, various components are added if desired, for example, organic silver salts, reducing agents therefor, toners, antifoggants, matte agents, crosslinking agents, dyestuffs, lubricants and surfactants. The intermediate layer preferably has a thickness of 0.05 to 5 $\mu$m, more preferably 0.1 to 3 $\mu$m. It is preferably formed by applying a coating solution of a binder in an aqueous solvent as previously mentioned and drying the coating.

In the photosensitive material of the invention, layers other than the inventive back layer optionally contain crosslinking agents, surfactants, matte agents, lubricants, dyestuffs, fillers and conductive particles as previously mentioned in conjunction with the inventive back layer.

The method of coating layers other than the inventive back layer is not critical. Any of the above-mentioned methods may be used. Such other layers can be coated using coating solutions in organic solvents.

If desired, the photosensitive material of the invention includes an antistatic or conductive layer, for example, layers containing soluble salts (e.g., chlorides and nitrates), evaporated metal layers, layers containing ionic polymers as described in U.S. Pat. Nos. 2,861,056 and 3,206,312, and layers containing insoluble inorganic salts as described in U.S. Pat. No. 3,428,451.

Further the photothermographic material of the invention may include a backside resistive heating layer as disclosed in U.S. Pat. Nos. 4,460,681 and 4,374,921.

The method for producing color images using the photothermographic material of the invention is disclosed, for example, in JP-A 13295/1995, page 10, left column, line 43 to page 11, left column, line 40. Stabilizers for stabilizing color dye images are exemplified in UKP 1,326,889, U.S. Pat. Nos. 3,432,300, 3,698,909, 3,574,627, 3,573,050, 3,764,337, and 4,042,394.

Layers constituting the photothermographic material of the invention can be coated by dipping, air knife coating, and flow coating as well as extrusion coating using a hopper of the type described in U.S. Pat. No. 2,681,294. If desired, two or more layers can be concurrently coated by the methods described in U.S. Pat. No. 2,761,791 and UKP 837,095.

In the photothermographic material of the invention, there may be contained additional layers, for example, a dye accepting layer for accepting a mobile dye image, an opacifying layer when reflection printing is desired, and a primer layer well known in the photothermographic art. The photothermographic material of the invention is preferably such that only a single sheet of the photosensitive material can form an image. That is, it is preferred that a functional layer necessary to form an image such as an image receiving layer does not constitute a separate photo-sensitive material.

The photothermographic material of the invention may be developed by any desired method although it is generally developed by heating after imagewise exposure. The preferred developing temperature is about 80 to 250° C., more preferably 100 to 140° C. and the preferred developing time is about 1 to 180 seconds, more preferably about 10 to 90 seconds.

Any desired technique may be used for the exposure of the photothermographic material of the invention. The preferred light source for exposure is a laser, for example, a gas laser, YAG laser, dye laser, and semiconductor laser. A semiconductor laser combined with a second harmonic generating device is also useful.

Upon exposure, the photosensitive material of the invention tends to generate interference fringes due to low haze. Known techniques for preventing generation of interference fringes are a technique of obliquely directing laser light to a photosensitive material as disclosed in JP-A 113548/1993 and the utilization of a multi-mode laser as disclosed in WO 95/31754. These techniques are preferably used herein.

Various supports may be used in the photothermographic material of the invention. Typical supports are polyethylene terephthalate film, polyethylene naphthalate film, cellulose nitrate film, cellulose ester film, polyvinyl acetal film, and polycarbonate film as well as glass, paper, and metals. Among others, biaxially oriented polyethylene terephthalate film of about 50 to 300 μm thick is preferred as the support from the standpoints of strength, dimensional stability and chemical resistance. If desired, the support is dyed, surface treated or subbed.

EXAMPLE

Examples of the present invention are given below by way of illustration and not by way of limitation.

Example 1

Preparation of Silver Halide Grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing 9 μmol/liter of dipotassium hexachloroiridate and 1 mol/liter of potassium bromide were added over 30 minutes by a controlled double jet method while maintaining the solution at pAg 7.7. The pH of the solution was lowered to cause flocculation and sedimentation for desalting. The solution was adjusted to pH 5.9 and pAg 8.2 by adding 0.1 gram of phenoxyethanol. There were obtained silver iodobromide grains in the form of cubic grains having an iodine content of 8 mol % in the core and 2 mol % on the average, a mean grain size of 0.05 μm, a coefficient of variation of projected area of 8%, and a (100) plane proportion of 79%.

The thus obtained silver halide grains were heated at 60° C., to which 85 μmol of sodium thiosulfate, 11 μmol of 2,3,4,5,6-pentafluorophenyldiphenylphosphine selenide, 15 μmol of tellurium compound 1, 3.4 μmol of chloroauric acid, and 260 μmol of thiocyanic acid were added per mol of silver. The solution was ripened for 120 minutes and quenched to 30° C., obtaining the end silver halide grains.

Preparation of Organic Acid Silver Emulsion

A mixture of 1.3 grams of stearic acid, 0.5 gram of arachidonic acid, 8.5 grams of behenic acid, and 300 ml of distilled water was stirred at 90° C. for 15 minutes. With vigorous stirring, 31.1 ml of 1N NaOH aqueous solution was added over 15 minutes to the solution, which was cooled to 30° C. 7 ml of 1N phosphoric acid aqueous solution was added to the solution. With more vigorous stirring, 0.02 gram of N-bromosuccinimide was added to the solution and the above-prepared silver halide emulsion was added in such an amount as to give 2.5 mmol of silver halide. Further, 25 ml of 1N silver nitrate aqueous solution was added over 2 minutes and stirring was continued for 90 minutes. The solids were separated by suction filtration and washed with water until the water filtrate reached a conductivity of 30 μS/cm. To the thus obtained solids was added 37 grams of a 1.2 wt % butyl acetate solution of polyvinyl acetate, followed by agitation. Agitation was stopped and the reaction mixture was allowed to stand whereupon it separated into an oil layer and an aqueous layer. The aqueous layer was removed together with the salts contained therein. To the oil layer was added 20 grams of a 2.5 wt % 2-butanone solution of polyvinyl butyral (Denka Butyral #3000-K by Denki Kagaku Kogyo K.K.), followed by agitation. Then 0.1 mmol of pyridinium bromide perbromide and 0.16 mmol of calcium bromide dihydrate were added thereto together with 0.7 gram of methanol, and 40 grams of 2-butanone and 7.8 grams of polyvinyl butyral (PVB B-76 by Monsanto Co.) were further added. The mixture was dispersed by means of a homogenizer, obtaining an organic acid silver salt emulsion of needle grains having a mean minor diameter of 0.04 μm, mean major diameter of 1 μm and a coefficient of variation of 30%.

Photosensitive Layer Coating Solution

Various chemicals were added to the above-prepared organic acid silver salt emulsion in amounts per mol of silver. With stirring at 25° C., 10 mg of sodium phenylthiosulfonate, 65 mg of coloring matter 1, 30 mg of coloring matter 2, 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. With stirring, there were further added 8 grams of 5-tribromomethylsulfonyl-2-methylthiadiazole, 6 grams of 2-tribromomethylsulfonylbenzothiazole, 5 grams of 4,6-ditrichloromethyl-2-phenyltriazine, 2 grams of disulfide compound 1, 135 grams of 1,1-bis(2-hydroxy-3,5-dimethylphenyl)-3,5,5-trimethylhexane, 5 grams of tetrachlorophthalic acid, 1.1 grams of Megafax F-176P (fluorinated surfactant by Dai-Nihon Ink Chemical Industry K.K.), 590 grams of 2-butanone and 10 grams of methyl isobutyl ketone.

The tellurium compound 1, disulfide compound 1, coloring matters 1 and 2 have the structures shown below.

tellurium compound 1

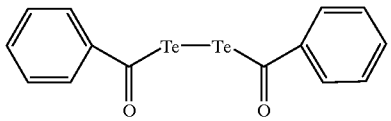

disulfide compound 1

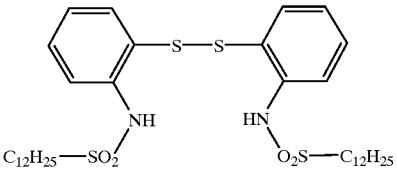

coloring matter 1

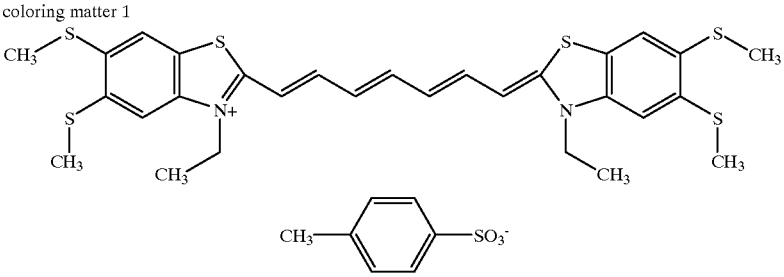

coloring matter 2

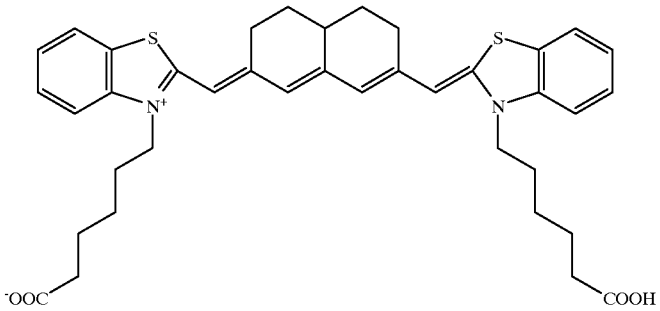

Emulsion Surface Protective Layer Coating Solution

A coating solution was prepared by dissolving 75 grams of HP620 (chlorinated polypropylene by Nippon Seishi K.K.), 5.7 grams of 4-methylphthalic acid, 1.5 grams of tetrachlorophthalic anhydride, 13.0 grams of phthalazine, 0.3 grams of Megafax F-176P, 2 grams of Sildex H31 (spherical silica having a mean particle size of 3 $\mu$m by Dokai Chemical K.K.), and 6 grams of Sumidur N3500 (polyisocyanate by Sumitomo-Bayer Urethane K.K.) in 3,070 grams of 2-butanone and 30 grams of toluene.

Antihalation Coating Solution

A coating solution was prepared by dissolving 24.0 grams of Byron 200 (polyester by Toyobo K.K.) in 1,000 grams of methyl ethyl ketone and adding the following ingredients thereto.

| | |
|---|---|
| Sumidur N3500 (polyisocyanate by Sumitomo-Bayern Urethane K.K.) | 0.3 g |
| Megafax F-176P (fluorinated surfactant by Dai-Nihon Ink Chemical Industry K.K.) | 0.1 g |
| Dyestuff 1 | 120 mg |
| Dyestuff 2 | 350 mg |
| Dyestuff 3 | 2.5 mg |

The dyestuffs 1, 2, and 3 have the structures shown below.

dyestuff 1

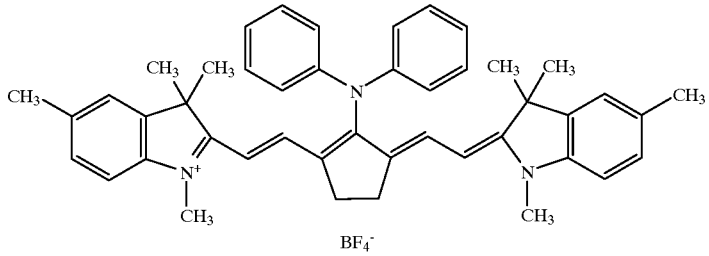

-continued dyestuff 2

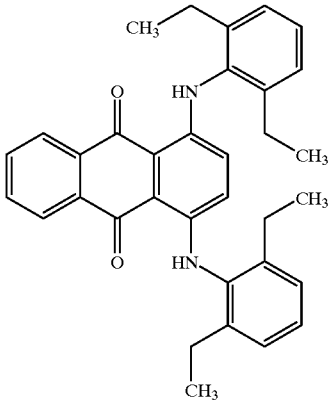

dyestuff 3

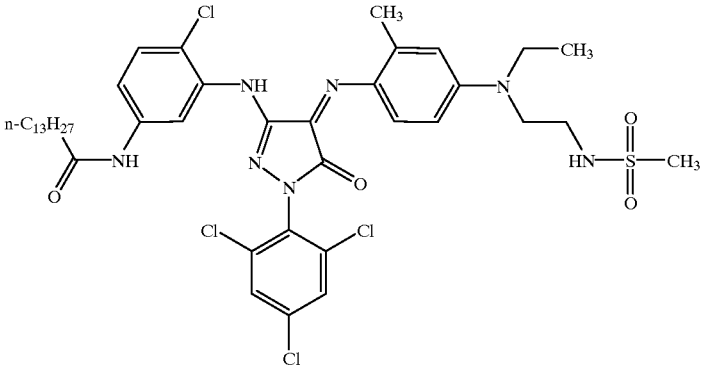

Back Layer Coating Solution

Coating solutions were prepared according to the following formulation using different binders as shown in Table 1.

| | |
|---|---|
| Binder (Table 1) | 20 g |
| Distilled water | 1000 g |
| Dinacol EX810 (epoxy compound by Nagase Chemical Industry K.K.) | 1.0 g |
| Sildex H51 (spherical silica with mean particle size 5 μm by Dokai Chemical K.K.) | 20 mg |
| $C_8F_{17}SO_3K$ | 2.5 mg |
| $C_{16}H_{33}OSO_3Na$ | 10 mg |

Preparation of Coated Sample

The support used was a biaxially oriented polyethylene terephthalate support of 175 μm thick which had been subbed on one surface. The back layer coating solution was applied to the subbed surface of the PET support so as to give a binder coverage of 2 g/m$^2$ and dried at 80° C. for 10 minutes. The back layer had a dry thickness of 2.1 μm.

The antihalation coating solution was applied to the other surface of the support in such an amount as to give an optical density of 0.7 at 810 nm and dried at 80° C. for 5 minutes to form an antihalation layer. The emulsion layer coating solution was applied thereon so as to give a silver coverage of 2.3 g/m$^2$ and dried at 80° C. for 5 minutes to form an emulsion layer. The surface protective layer coating solution was applied thereon so as to give a binder coverage of 2.0 g/m$^2$ and dried at 80° C. for 5 minutes to form a surface protective layer.

In this way, there were prepared photosensitive material sheet samples, designated Nos. 101 to 117. The samples were conditioned in an atmosphere at 25° C. and RH 60% for 10 days before they were examined by the following tests.

Photographic Properties

The photosensitive material was exposed by means of a laser sensitometer equipped with a 810-nm diode and heated at 120° C. for 25 seconds for development whereupon the image was determined for sensitivity (S), fog and maximum density (Dmax) by means of a densitometer (fresh photographic properties). Sensitivity (S) was evaluated in terms of an inverse of a ratio of an exposure dose providing a density higher than the minimum density (Dmin) by 0.3 and expressed in a relative value based on a sensitivity value of 100 for coated sample No. 106. It is noted that the angle between an incident laser beam and the surface of photosensitive material exposed thereto was 80 degrees.

The sample sheets were further conditioned in an atmosphere at 25° C. and RH 75% for 24 hours, and stacked such that the photosensitive layer surface of one sheet was in contact with the back surface of an adjacent sheet. The stacked sample sheets were stored at 50° C. for 3 days. The sample was similarly measured for photographic properties (thermal photographic properties).

Sticking Test

A sample sheet was cut into sections of 5 cm×5 cm, which were conditioned at 25° C. and RH 80% for 2 hours. The sample sections were stacked such that the photosensitive layer surface of one section was in contact with the back surface of an adjacent section and placed in a moisture-proof bag, which was heat sealed. With a weight of 3 kg per 5 centimeter squared rested thereon, the sample was allowed to stand at 25° C. for 24 hours. Thereafter, the sample surface was visually observed and classified into the following ratings A to D.

A: no perceivable changes on the surface
B: a slight change of surface luster
C: a change of surface luster
D: stuck For each sample, both the photosensitive layer side and the back layer side were observed and a worse rating was assigned.

The results are shown in Table 1

TABLE 1

| Sample No. | Back layer binder (equilibrium moisture content @ 25° C./RH 60%) | Fresh photographic properties Fog | Dmax | S | Thermal photographic properties Fog | Dmax | S | Sticking |
|---|---|---|---|---|---|---|---|---|
| 101* | lime treated gelatin (12.4 wt %) | 0.176 | 3.2 | 100 | 0.252 | 3.4 | 130 | D |
| 102* | polyvinyl alcohol (3.8 wt %) | 0.179 | 3.3 | 110 | 0.291 | 3.4 | 120 | C |
| 103* | lime treated gelatin/P-5 = 80/20 | 0.176 | 3.3 | 100 | 0.252 | 3.4 | 120 | C |
| 104* | lime treated gelatin/P-5 = 60/40 | 0.175 | 3.2 | 100 | 0.220 | 3.3 | 120 | C |
| 105 | lime treated gelatin/P-5 = 40/60 | 0.168 | 3.2 | 100 | 0.192 | 3.4 | 110 | B |
| 106 | P-4 (0.4 wt %) | 0.162 | 3.2 | 100 | 0.188 | 3.4 | 110 | A |
| 107 | P-5 (0.2 wt %) | 0.158 | 3.3 | 100 | 0.180 | 3.4 | 100 | A |
| 108 | P-6 (0.4 wt %) | 0.158 | 3.2 | 110 | 0.185 | 3.4 | 110 | A |
| 109 | P-7 (0.5 wt %) | 0.160 | 3.3 | 100 | 0.188 | 3.3 | 110 | A |
| 110 | FINETEX ES611 (0.3 wt %) | 0.164 | 3.3 | 100 | 0.187 | 3.4 | 100 | A |
| 111 | HYDRAN APX101H (0.3 wt %) | 0.160 | 3.3 | 110 | 0.182 | 3.3 | 120 | A |
| 112 | L-1638 (0.5 wt %) | 0.158 | 3.2 | 110 | 0.187 | 3.3 | 100 | A |
| 113 | Sebian A4635 (0.5 wt %) | 0.158 | 3.3 | 100 | 0.184 | 3.4 | 110 | A |
| 114 | Chemipearl S120 (0.3 wt %) | 0.162 | 3.3 | 100 | 0.189 | 3.3 | 110 | A |
| 115 | Sebian A117 (0.4 wt %) | 0.159 | 3.3 | 100 | 0.189 | 3.4 | 110 | A |
| 116 | G351 (0.5 wt %) | 0.159 | 3.3 | 100 | 0.182 | 3.3 | 110 | A |
| 117 | lime treated gelatin/P-5 = 20/80 | 0.162 | 3.3 | 100 | 0.188 | 3.4 | 110 | A |

*comparison

As is evident from Table 1, photosensitive material samples within the scope of the invention exhibit minimal fog after the thermal test. No sticking occurred between photosensitive material sheets and their surface remained unchanged.

Example 2

Photosensitive material samples were prepared as in Example 1 except that a PET support of 100 μm thick was used and the formulations of the photosensitive layer and back layer were changed as follows.

Preparation of Organic Acid Silver Emulsion

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a 1.2 wt % butyl acetate solution of polyvinyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% isopropyl alcohol solution of polyvinyl butyral (Denka Butyral #3000-K by Denki Kagaku Kogyo K.K.). The dispersion was further dispersed in 600 grams of polyvinyl butyral (Denka Butyral #4000-2 by Denki Kagaku Kogyo K.K.) and 300 grams of isopropyl alcohol, obtaining an organic acid silver salt emulsion of needle grains having a mean minor diameter of 0.05 μm, a mean major diameter of 1.2 μm, and a coefficient of variation of 25%.

Photosensitive Layer Coating Solution

Various chemicals were added to the above-prepared organic silver emulsion in amounts per mol of silver. With stirring at 25° C., 10 mg of sodium phenylthiosulfonate, 65 mg of coloring matter a, 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. With stirring, there were further added 8 grams of 5-tribromomethylsulfonyl-2-methylthiadiazole, 6 grams of 2-tribromomethylsulfonyl-benzothiazole, 5 grams of 4,6-ditrichloromethyl-2-phenyltriazine, 2 grams of disulfide compound a, 135 grams of 1,1-bis(2-hydroxy-3,5-dimethylphenyl)-3,5,5-trimethylhexane, 5 grams of tetrachlorophthalic acid, 2.2 grams of a hydrazine derivative a, 1.1 grams of Megafax F-176P (fluorinated surfactant by Dai-Nihon Ink Chemical Industry K.K.), 590 grams of 2-butanone and 10 grams of methyl isobutyl ketone.

The coloring matter a, disulfide compound a, and hydrazine derivative a have the following chemical structure.

hydrazine derivative a

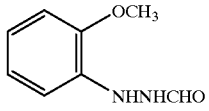

coloring matter a

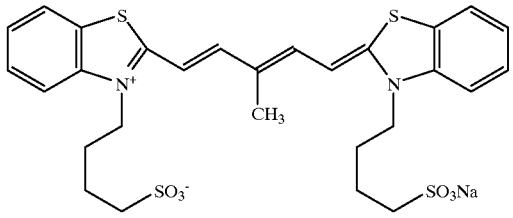

-continued disulfide compound a

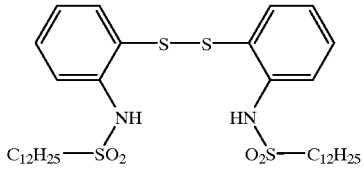

Back Layer Coating Solution

Coating solutions were prepared according to the following formulation using different binders as shown in Table 1.

| | |
|---|---|
| Binder (Table 1) | 15 g |
| Distilled water | 1000 g |
| Sodium p-dodecylbenzenesulfonate | 30 mg |
| Dinacol EX313 (epoxy compound by Nagase Chemical Industry K.K.) | 100 mg |
| Dyestuff a | 50 mg |
| Dyestuff b | 110 mg |
| Dyestuff c | 40 mg |

-continued

| | |
|---|---|
| Dyestuff d | 50 mg |
| Polymethyl methacrylate fine particles (mean particle size 5 μm) | 20 mg |

The dyestuffs a, b, c, and d have the structures shown below.

dyestuff a

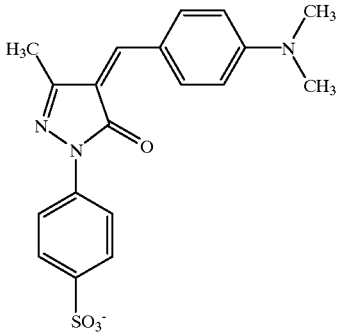

dyestuff b

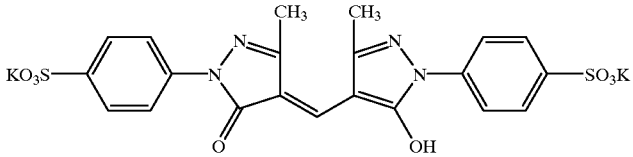

dyestuff c

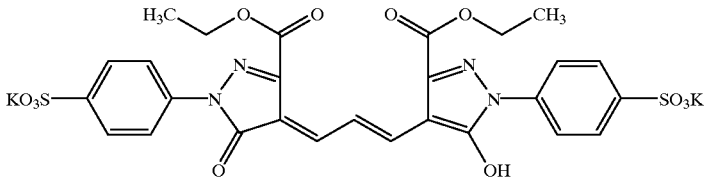

dyestuff d

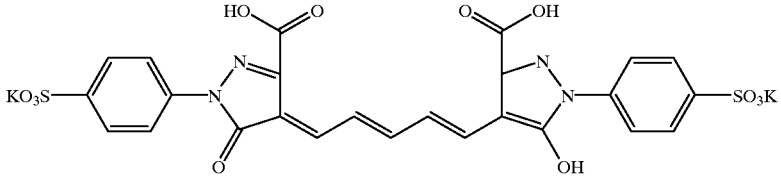

The back layer coating solution was applied to the support so as to give a binder coverage of 1.5 g/m$^2$ and dried at 80° C. for 5 minutes. The back layer had a dry thickness of 2.1 μm.

The thus obtained photosensitive material samples were tested as in Example 1. There were obtained equivalent results to those in Example 1 depending on the binder used in the back layer. It was found that photosensitive material samples within the scope of the invention exhibit minimal fog and experience little surface change by sticking after the thermal test.

Example 3

A photosensitive material was prepared as in Example 1 except that the silver halide grains, the back layer, and the back surface protective layer were changed as follows.

Preparation of Silver Halide Grains

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by a controlled double jet method while maintaining the solution at pAg 7.7. The pH of the solution was lowered to cause flocculation and sedimentation for desalting. The solution was adjusted to pH 5.9 and pAg 8.0 by adding 0.1 gram of phenoxyethanol. There were obtained silver iodobromide grains in the form of cubic grains having a silver iodide content of 8 mol % in the core and 2 mol % on the average, a mean grain size of 0.07 μm, a coefficient of variation of projected area of 8%, and a (100) plane proportion of 86%.

The thus obtained silver halide grains were heated at 60° C., to which 85 μmol of sodium thiosulfate, 11 μmol of 2,3,4,5,6-pentafluorophenyldiphenylphosphine selenide, 2 μmol of tellurium compound 1, 3.3 μmol of chloroauric acid, and 230 μmol of thiocyanic acid were added per mol of silver. The solution was ripened for 120 minutes. Thereafter, the temperature was adjusted to 50° C. and with stirring, $5\times10^{-4}$ mol of sensitizing dye A and $2\times10^{-4}$ mol of sensitizing dye B were added per mol of the silver halide. Further, 3.5 mol % of the silver of potassium iodide was added. The solution was agitated for 30 minutes and quenched to 30° C., completing the preparation of silver halide grains A.

tellurium compound 1

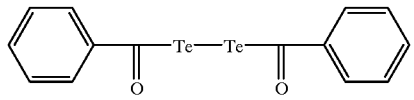

sensitizing dye A

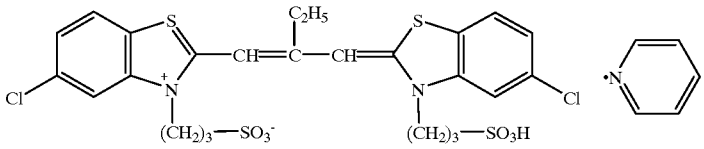

sensitizing dye B

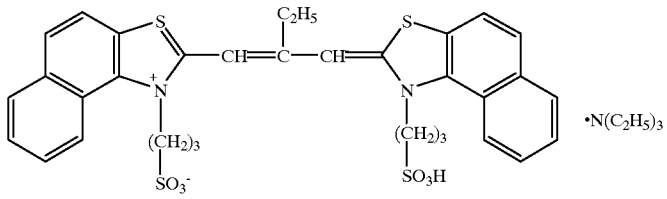

Preparation of Color Former Dispersion

To 35 grams of ethyl acetate were added 2.5 grams of compound 1 and 7.5 grams of compound 2. With stirring, the compounds were dissolved. To the solution was added 50 grams of a 10 wt % solution of polyvinyl alcohol. The mixture was agitated for 5 minutes by a homogenizer. The ethyl acetate was then volatilized off and the residue was diluted with water, obtaining a color former dispersion.

compound 1

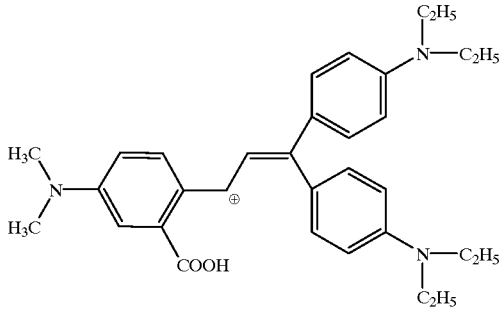

compound 2

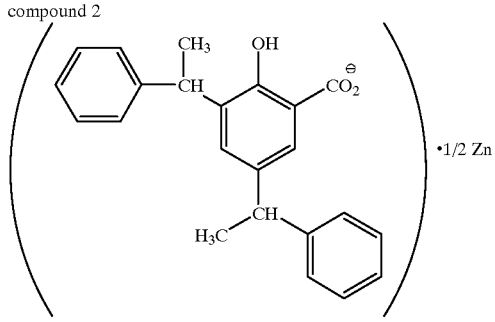

Preparation of Back Layer Coating SolutionA back layer coating solution was prepared by adding 50 grams of the above-prepared color former dispersion, 20 grams of compound 3, and 250 grams of water or an aqueous solvent of the type shown in Table 2 to 60 grams of a binder of the type shown in Table 2.

compound 3

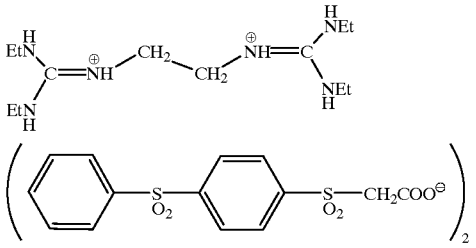

Preparation of Back Surface Protective Layer Coating Solution

A back surface protective layer coating solution was prepared by adding 0.09 gram of surfactant A, 0.05 gram of surfactant B, 0.7 gram of silica particulates (mean particle size 12 μm), 0.6 gram of 1,2-bis(vinylsulfonylacetamide)-ethane, 0.25 gram of a lubricant (liquid paraffin dispersed in gelatin, mean particle size 0.1 μm), and 164 grams of water to 10 grams of inert gelatin.

surfactant A

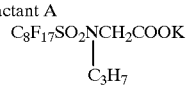

surfactant B

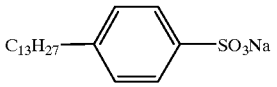

Preparation of Coated Sample

The support used was a biaxially oriented polyethylene terephthalate support of 175 μm thick which was tinted with a blue dyestuff. The photosensitive layer coating solution was coated onto the PET support to a silver coverage of 1.9 g/m$^2$. The surface protective layer coating solution was coated onto the photosensitive layer to a binder coverage of 1.8 g/m$^2$. These two layers were concurrently coated, held at 10° C. for 1 minute, and then dried at 50° C. for 20 minutes. After drying, the back layer coating solution was coated onto the back surface of the PET support (opposite to the photosensitive layer) so as to provide an optical density of 0.7 at 647 nm and the back surface protective layer coating solution was coated thereon to a binder coverage of 1.8 g/m$^2$. The coating procedure was the same as above.

Photographic Properties

The test was the same as in Example 1 except that the photosensitive material was exposed to light at an angle of 30° relative to a normal by means of a 647-nm Kr laser sensitometer (maximum power 500 mW).

Optical Density of the Back Surface

The test used a first coated sample which was conditioned for 10 days at 25° C. and RH 60% as in Example 1 and a second coated sample which was further conditioned for 3 days at 40° C. and RH 70%. The optical density of the back surface of a green photosensitive material (prior to development) is the optical density $D_1$ of the sample from which the photosensitive layer and the surface protective layer were stripped minus the optical density $D_B$ of the base. The coated sample was developed by heating at 120° C. for 20 seconds. The optical density of the back surface of a developed photosensitive material (subsequent to development) is the optical density $D_2$ of the sample from which the photosensitive layer and the surface protective layer were stripped minus the optical density $D_B$ of the base. Note that the optical density was measured at 647 nm.

Sticking Test

The test was the same as in Example 1.

The results are shown in Table 2.

TABLE 2

| Sample No. | Solvent of back layer coating solution | Back layer binder (equilibrium moisture content @ 25° C./RH 60%) | Fresh photographic properties Fog | Dmax | S | Back surface optical density (before/after development) |
|---|---|---|---|---|---|---|
| 301* | water | lime-treated gelatin (12.4 wt %) | 0.22 | 3.1 | 100 | 0.67/0.28 |
| 302* | water | PVA (3.8 wt %) | 0.24 | 3.0 | 100 | 0.71/0.09 |
| 303 | water | LACSTAR3307B (0.6 wt %) | 0.18 | 3.0 | 110 | 0.70/0.05 |
| 304 | water | VONCOAT4280 (1.0 wt %) | 0.18 | 3.0 | 100 | 0.72/0.06 |
| 305 | water | FINETEX ES675 (1.6 wt %) | 0.19 | 3.0 | 100 | 0.71/0.05 |
| 306 | water | HYDRAN AP10 (0.9 wt %) | 0.18 | 3.1 | 100 | 0.69/0.06 |
| 307 | water | Chemipearl S120 (1.0 wt %) | 0.18 | 3.0 | 105 | 0.67/0.06 |
| 308 | water | G576 (0.8 wt %) | 0.19 | 3.1 | 110 | 0.70/0.05 |
| 309 | water | P-8 (0.8 wt %) | 0.19 | 3.0 | 100 | 0.72/0.08 |
| 310 | water | P-9 (1.1 wt %) | 0.19 | 3.1 | 100 | 0.71/0.05 |
| 311 | water | P-10 (0.9 wt %) | 0.18 | 3.0 | 100 | 0.70/0.06 |
| 312 | water/methanol = 70/30 | LACSTAR3307B (0.6 wt %) | 0.18 | 3.1 | 105 | 0.71/0.05 |
| 313 | water/methanol = 50/50 | LACSTAR3307B (0.6 wt %) | 0.18 | 3.0 | 100 | 0.72/0.07 |
| 314 | water/methanol = 70/30 | P-8 (0.8 wt %) | 0.19 | 3.0 | 100 | 0.69/0.06 |
| 315 | water/methanol = 50/50 | P-8 (0.8 wt %) | 0.18 | 3.0 | 100 | 0.68/0.05 |

| Sample No. | Sticking | Thermal photographic properties Fog | Dmax | S | Back surface optical density after humid storage (before/after development) |
|---|---|---|---|---|---|
| 301* | C | 0.57 | 3.1 | 100 | 0.45/0.19 |
| 302* | C | 0.54 | 3.0 | 95 | 0.55/0.07 |
| 303 | A | 0.25 | 2.9 | 95 | 0.68/0.05 |
| 304 | A | 0.26 | 3.0 | 100 | 0.69/0.06 |
| 305 | A | 0.26 | 3.0 | 100 | 0.61/0.05 |

TABLE 2-continued

| | | | | | |
|---|---|---|---|---|---|
| 306 | A | 0.24 | 3.0 | 100 | 0.67/0.07 |
| 307 | A | 0.25 | 2.8 | 95 | 0.67/0.07 |
| 308 | A | 0.25 | 2.9 | 95 | 0.67/0.05 |
| 309 | A | 0.26 | 3.0 | 100 | 0.68/0.07 |
| 310 | A | 0.23 | 2.9 | 95 | 0.64/0.05 |
| 311 | A | 0.25 | 3.0 | 100 | 0.68/0.06 |
| 312 | A | 0.24 | 3.0 | 100 | 0.68/0.05 |
| 313 | A | 0.26 | 2.9 | 95 | 0.70/0.06 |
| 314 | A | 0.25 | 3.0 | 100 | 0.66/0.05 |
| 315 | A | 0.26 | 3.0 | 95 | 0.68/0.06 |

*comparison
PVA: polyvinyl alcohol PVA205 by Kurare K.K.
P-8: latex of styrene/butadiene/acrylic acid = 70/27/3 (wt %)
P-9: latex of styrene/butyl acrylate/methacrylic acid = 65/34/1 (wt %)
P-10: latex of methyl methacrylate/2-ethylhexyl acrylate/acrylic acid = 70/27/3 (wt %)

The effectiveness of the invention is evident from Table 2. Where a bleachable dye is used in the back surface, the photosensitive material of the invention prevents degradation of the dye during storage, has a high optical density prior to development, and shows promoted decolorization after development.

There has been described a photothermographic material having a photosensitive layer and a back layer on opposite surfaces of a support wherein the back layer is improved so as to minimize fog and prevent sticking and hence, surface change when sheets of the material are stored in a humid atmosphere. The back layer can be formed without a need for organic solvents which are harmful to the environment and human body and relatively expensive.

Reasonable modifications and variations are possible from the foregoing disclosure without departing from either the spirit or scope of the present invention as defined by the claims.

What is claimed is:

1. A black and white photothermographic material capable of forming a black and white image through heat development, comprising:

a support comprising a biaxially oriented polyethylene terephthalate film having a thickness of about 50 to 300 microns and having at least one photosensitive layer on one side of said support and a non-photosensitive layer on the side of the support opposite to the side having the photosensitive layer wherein, said at least one said photosensitive layer contains (I) a photosensitive silver halide, (ii) a non-photosensitive silver salt, and (iii) a reducing agent for the silver salt, said at least one photosensitive layer forming a black and white image through heat development, and said non-photosensitive layer is formed by applying a coating solution of a binder containing at least 75% by weight of a polymer latex selected from the group consisting of acrylic resins, vinyl acetate resins, polyester resins, polyurethane resins, rubbery resins, vinyl chloride resins, vinylidene chloride resins, polyolefin resins, and copolymers thereof, dispersed in a solvent containing at least 30% by weight of water and drying the coating.

2. The photothermographic material of claim 1 wherein said polymer latex is of a polymer having an equilibrium moisture content of up to 2% by weight at 25° C. and RH 60%.

3. The photothermographic material of claim 1 wherein said non-photosensitive silver salt is an organic silver salt.

4. The photothermographic material of claim 1 wherein said non-photosensitive silver salt is a silver salt of an aliphatic carboxylic acid having at least 10 carbon atoms.

5. The photothermographic material of claim 1 wherein the non-photosensitive layer has a thickness of about 0.05 to about 20 $\mu$m.

6. The photothermographic material of claim 1 wherein said polymer latex is coated in a coverage of about 0.3 to about 7.0 grams per square meter of the photothermographic material.

7. The photothermographic material of claim 1 wherein said polyolefin resin is styrene-butadiene resin.

8. The photothermographic material of claim 1 wherein said polymer latex is selected from the group consisting of methyl methacrylate/ethyl acrylate/methacrylic acid copolymers, methyl methacrylate/2-ethylhexyl acrylate/styrene/acrylic acid copolymers, styrene/butadiene/acrylic acid copolymers, styrene/butadiene/divinyl benzene/methacrylic acid copolymers, methyl methacrylate/vinyl chloride/acrylic acid copolymers, and vinylidene chloride/ethyl acrylate/acrylonitrile/methacrylic acid copolymers.

9. The photothermographic material of claim 1, wherein said polymer latex is of a polymer having an equilibrium moisture content of 0.1 to 2.0% by weight at 25° C. and RH 60%.

10. The photothermographic material of claim 1, wherein the polymer latex is a mixture of two or more of said polymer latexes selected from the group consisting of acrylic resins, vinyl acetate resins, polyester resins, polyurethane resins, rubbery resins, vinyl chloride resins, vinylidene chloride resins, polyolefin resins, and copolymers thereof, and the total combined weight of the polymer latexes is more than 75% by weight of the binder.

11. The photothermographic material of claim 1, wherein the non-photosensitive layer has a thickness of about 0.5 to about 5 $\mu$m.

12. The photothermographic material of claim 1, wherein the coating solution for forming the back layer contains the binder and the aqueous solvent in a weight ratio of from about 2:98 to about 15:85.

13. A black and white photothermographic material capable of forming a black and white image through heat development, comprising:

a support comprising a biaxially oriented polyethylene terephthalate film having a thickness of about 50 to 300 microns and having at least one photosensitive layer on one side of said support and a non-photosensitive layer on the side of the support opposite to the side having the photosensitive layer wherein, said at least one photosensitive layer contains (i) a photosensitive silver halide, (ii) a non-photosensitive silver salt, and (iii) a reducing agent for the silver salt, and (iv) a binder comprising polyvinyl butyral, wherein said at least one photosensitive layer forms a black and white image through heat development, and said non-photosensitive layer which is formed by applying a coating solution of a binder containing at least 75% by weight of a polymer latex selected from the group consisting of acrylic resins, vinyl acetate resins, polyester resins, polyurethane resins, rubbery resins, vinyl chloride resins, vinylidene chloride resins, polyolefin resins, and copolymers thereof, dispersed in a solvent containing at least 30% by weight of water and drying the coating.

* * * * *